US007950840B2

(12) United States Patent
Liu et al.

(10) Patent No.: US 7,950,840 B2
(45) Date of Patent: May 31, 2011

(54) STRUCTURE FOR CHRISTMAS LIGHT

(75) Inventors: Chun-Ming Liu, Hsinchu (TW); Uei-Shin Chen, Hsinchu (TW); Chih-Wei Liu, Hsinchu (TW)

(73) Assignee: Chun-Ming Liu, Hsinchu (TW)

( * ) Notice: Subject to any disclaimer, the term of this patent is extended or adjusted under 35 U.S.C. 154(b) by 208 days.

(21) Appl. No.: 12/417,133

(22) Filed: Apr. 2, 2009

(65) Prior Publication Data

US 2010/0254161 A1 Oct. 7, 2010

(51) Int. Cl.
*H01R 33/00* (2006.01)

(52) U.S. Cl. ..... 362/654; 362/647; 362/652; 439/699.1; 439/699.2

(58) Field of Classification Search ..... 362/647, 362/652, 654; 439/699.1, 680, 699.2
See application file for complete search history.

(56) References Cited

U.S. PATENT DOCUMENTS

| | | | | |
|---|---|---|---|---|
| 7,575,362 | B1 * | 8/2009 | Hsu | 362/654 |
| 2008/0198629 | A1 * | 8/2008 | Lee | 362/654 |
| 2009/0086510 | A1 * | 4/2009 | Li et al. | 362/653 |

* cited by examiner

*Primary Examiner* — Anabel M Ton
(74) *Attorney, Agent, or Firm* — Rabin & Berdo, P.C.

(57) ABSTRACT

A structure for LED Christmas light is provided, including a light holder, being a hollow body having a separating part connected to the inner wall of the light holder to divide the hollow interior of the light holder into two cavities. Each of the two opposite sides of the inner wall of the light holder connected to the separating part forms a slot and face the surface of the separating part of the two cavities, with each having a guiding channel. Two wire sets are fixed inside the two cavities. An LED light bulb has a positive pin and a negative pin inserted inside the guiding channel, respectively, and being electrically connected to the wire sets. A light cap has a holding part passing the LED light bulb to tightly engage to the top of the light holder so as to fix the LED light bulb to the light holder.

9 Claims, 10 Drawing Sheets

STRUCTURE FOR CHRISTMAS LIGHT

FIELD OF THE INVENTION

The present invention generally relates to a structure for Christmas light, and more specifically to a structure for Christmas light using light-emitting diode (LED), easy to assemble and having sturdy hold after assembly.

BACKGROUND OF THE INVENTION

Because the tungsten light bulb consumes more electric energy and results in secondary environment contamination, light-emitting diode (LED) becomes a promising unit and an attractive alternative for illumination, especially as Christmas lights. The Christmas lights are usually hanged on Christmas trees and constantly lighted, therefore, it is necessary to build a structure with lower power consumption, longer life span and light in weight. LED provides an excellent option.

As the LED Christmas light is small in size, the connection between the components must be simplified to make the assembly easy. A conventional LED Christmas light includes an LED light bulb, light base for buckling the LED light bulb, a bulb base for housing the light base, and a wire connected to electrodes. The LED light bulb has a pair of pins. After the light bulb is engaged to the light base, the pins extend through the holes of the light base and are folded upward to form electrical contact. The light holder includes a cavity, with electrodes push against on the side walls of the cavity so as to ensure the connection of wire to the light holder. After the light base installed with light bulb is inserted into the cavity of the light holder, the pins are in contact with the electrodes. When plug in to the power, the light bulb is lighted.

However, for assembly, the above structure requires the pins of the LED light bulb to penetrate through the holes of the light base, bended and then reinserted into the light holder, as well as using the electrodes and light holder to fasten the wire. The assembly process is complicated and may damage the coated (electroplating or electroless plating or vacuum coating) thin film when bending the pins, which may lead to the corrosion and/or erosion and electrical leakage. Furthermore, the pins are bended many times during the manufacturing and testing, and are prone to break. The safety and reliability of the products are both easily compromised.

SUMMARY OF THE INVENTION

The primary object of the present invention is to provide a structure for LED Christmas light, which is easy to assemble and maintain strong holds between components after assembly so that the light bulb and the electrodes can be in firm contact.

To achieve the above object, the present invention provides a structure for LED Christmas light, including a light holder, being a hollow body with a skeletonized top and a skeletonized bottom. The center of the light holder includes a separating part connected to the inner wall of the light holder to divide the hollow interior of the light holder into two cavities. Each of the two opposite sides of the inner wall of the light holder connected to the separating part forms a slot extending downwards from the top to face the surface of the separating part of the two cavities, with each having a guiding channel. Two wire sets are fixed inside the two cavities. An LED light bulb has a positive pin and a negative pin inserted inside the guiding channel, respectively, and being electrically connected to the wire sets. The LED light bulb sits across the top of the separating part. A light cap includes a ring-shaped holding part and two plugging parts of the shape matching the slots. The plugging parts are inserted into the two slots respectively so that the holding part pass the LED light bulb to tightly engage to the top of the light holder so as to fix the LED light bulb to the light holder.

The main feature of the structure for LED Christmas light of the present invention includes a plurality of matching and unique designs of the components so that the components can be easily matched and elegantly engaged for correct assembly. The electrodes of the present invention are not the conventional plate electrodes. Instead, the present invention uses the flexible electrodes having more functionality. After assembling the light holder and the flexible electrodes, the LED light bulb can contact the flexible electrodes for electrical connection after inserted into the cavity, and no additional complicated means is required. A buckle structure is also included in the light bulb and the light cap of the present invention to prevent the light bulb from disengaging from the light holder. A shade can be formed on the end of the light cap to protect the light bulb from damage and to enhance the decorative function of the LED light bulb.

The foregoing and other objects, features, aspects and advantages of the present invention will become better understood from a careful reading of a detailed description provided herein below with appropriate reference to the accompanying drawings.

BRIEF DESCRIPTION OF THE DRAWINGS

The present invention can be understood in more detail by reading the subsequent detailed description in conjunction with the examples and references made to the accompanying drawings, wherein.

DETAILED DESCRIPTION OF THE PREFERRED EMBODIMENTS

Figure 1:
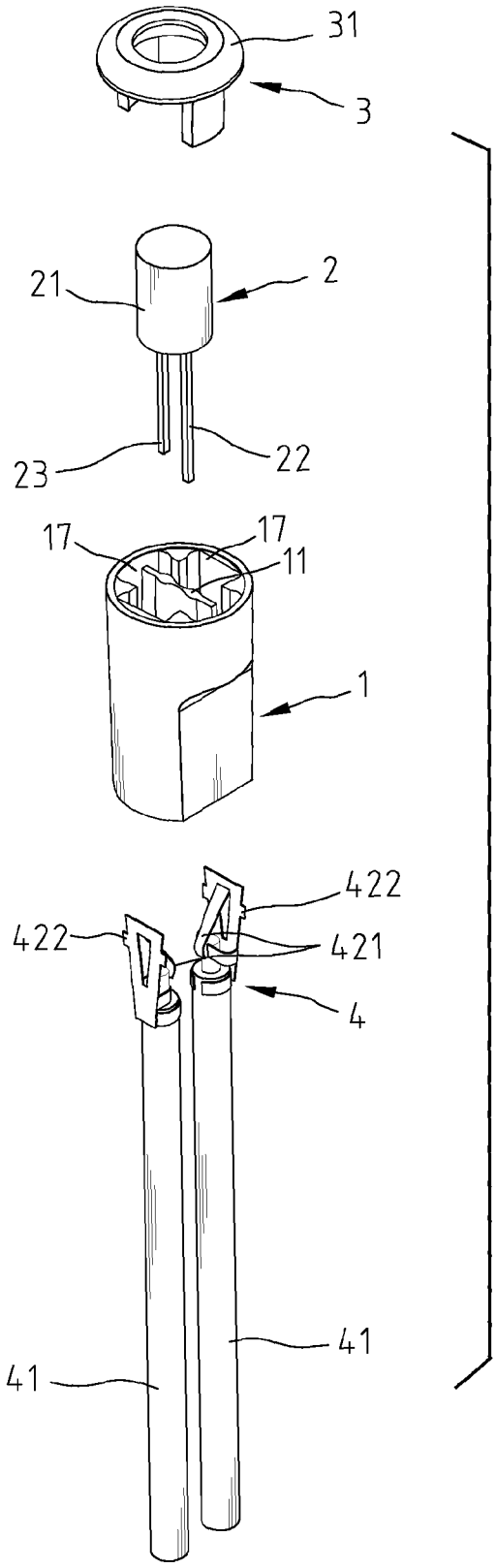
FIG. 1 shows a dissected view of the structure for Christmas light according to the invention.
Figure 2:
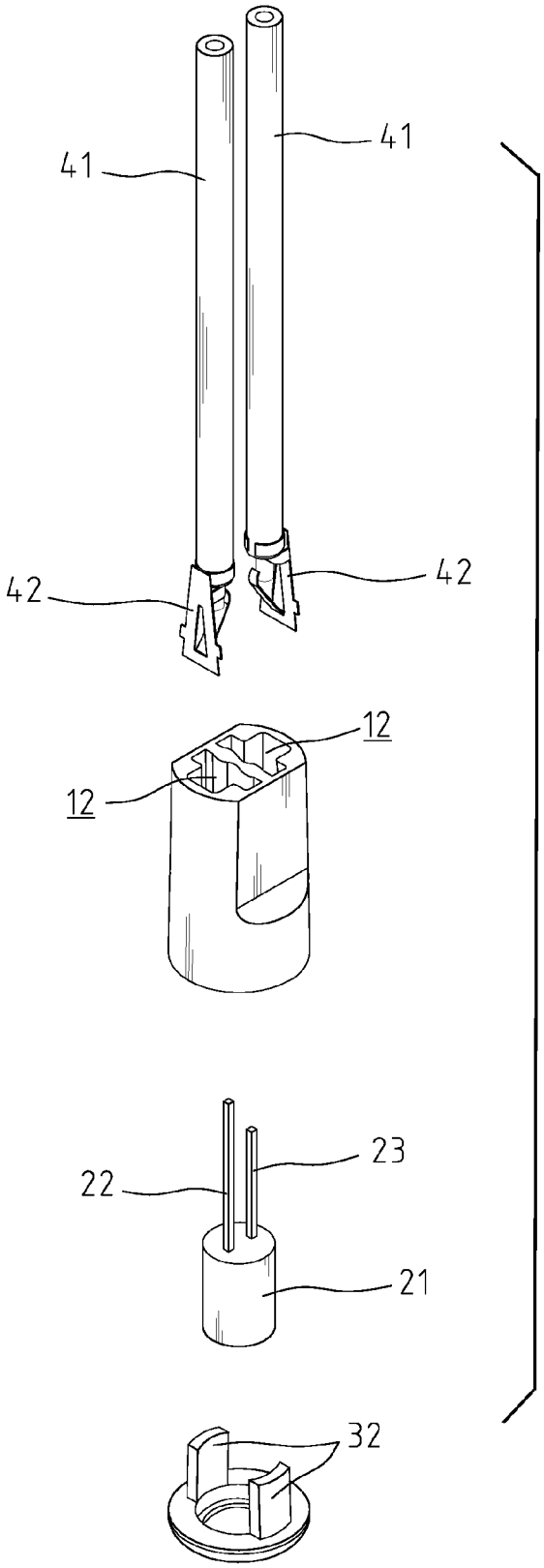
FIG. 2 shows another dissected view from a different angle of the structure for Christmas light according to the present invention.
Figure 3:
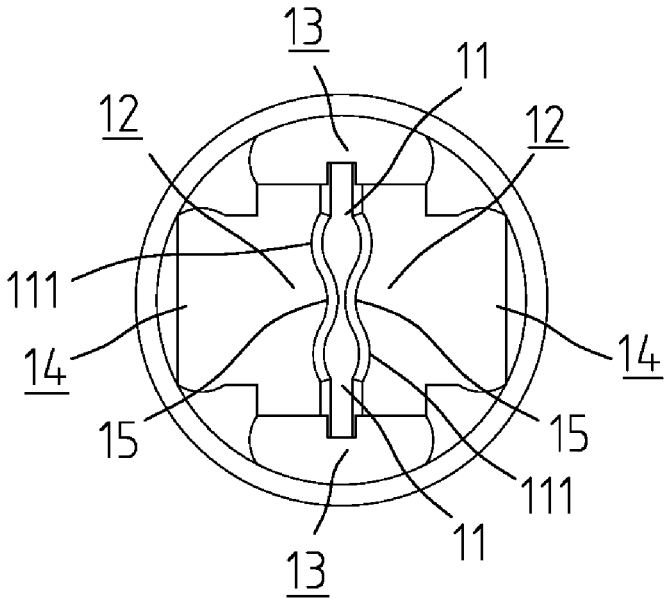
FIG. 3 shows a top view of the light holder of the structure for Christmas light according to the present invention.

FIGS. 1-3 show two schematic views of the present invention from different angles and a top view of the light holder, respectively. The structure for LED Christmas light of the present invention includes a light holder 1, an LED light bulb 2, a light cap 3 and two wire sets 4.

Light holder 1 is a hollow cone body that is wide at the top and narrow at the bottom, and has a skeltonized top and a skeletonized bottom. The center of light holder 1 includes a thin plate-shaped separating part 11 connected to inner wall 17 of light holder 1 to divide the hollow interior of light holder 1 into two cavities 12. Each of the two opposite sides of inner wall 17 of light holder 1 connected to separating part 11 forms a slot 13 extending downwards from the top. Each of the two opposite sides of inner wall 17 of light holder 1 facing separating part 11 includes a lock trench extending downwards from the top. Because the upper part of light holder 1 is round, slot 13 and lock trench 14 both have slightly arc surface. The top view of light holder 1 shows that lock trench 14 and slot 13 form a cross, i.e., interleaved, arrangement. The two surfaces of separating part 11 respectively form two guiding edges 111 extending from top of separating part 11 to bottom. The surface between two guiding edges 111 forms a guiding channel 15. Each wire set 4 includes a wire 41 and a flexible electrode 42 electrically connected to wire 41. Flexible electrode 42 includes a flexible contact part 421 and two convex edges 422. LED light bulb 2 includes a bulb body 21 and has a positive pin 22 and a negative pin 23 (assuming shorter than positive pin 22), both extending from bulb body 21. Light cap 3 includes a ring-shaped holding part 31, having an outer diameter the same as the outer diameter of the top of light holder 1, and an inner diameter slightly larger than bulb body 21 of LED light bulb 2. Two plugging parts extend vertically from the bottom of holding part 31 have the shape matching plugging part 32 of slot 13.

Figure 4:
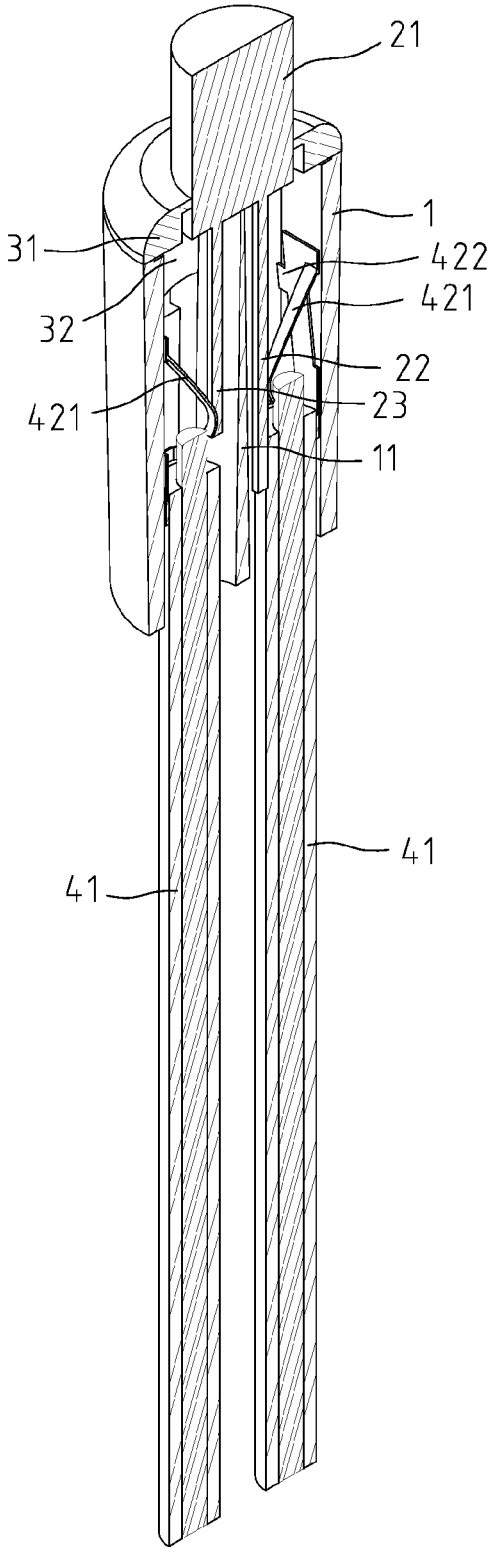
FIG. 4 shows a cross-sectional view of the Christmas light according to the present invention.

Also refer to FIG. 4. Wires 41 connected to flexible electrodes 42 are embedded respectively into cavities 12 from the bottom of light holder 1, move upwards along lock trenches 14 to the top of light holder 1. Wire sets 4 are fixed by the interference between lock trenches 14 and two convex edges 422 of flexible electrodes 42. Contact part 421 of flexible electrode 42 is close to the surface of separating part 11 and corresponds to guiding channel 15. Two pins 22, 23 of LED light bulb 2 insert respectively along guiding channel 15 into light holder 1 so that bulb body 21 sits across the tip of separating part 11 with pins 22, 23 forming a clip on the two surfaces of separating part 11 and in contact with contact part 421 of flexible electrode 42. When wires 41 are connected to a power, LED light bulb 2 will be lighted. Ring-shaped holding part 31 of light cap 3 sheathes over bulb body 21. Two plugging parts 32 of light cap 31 are plugged correspondingly into two slots 13, with holding parts 31 downwards contacting the top of light holder 1 to prevent LED light bulb 2 from tilting and leading to bad contact between pins 22, 23 and contact parts 421 of flexible electrodes 42, or prevent LED light bulb 2 from falling out of light holder 1.

Figure 5:
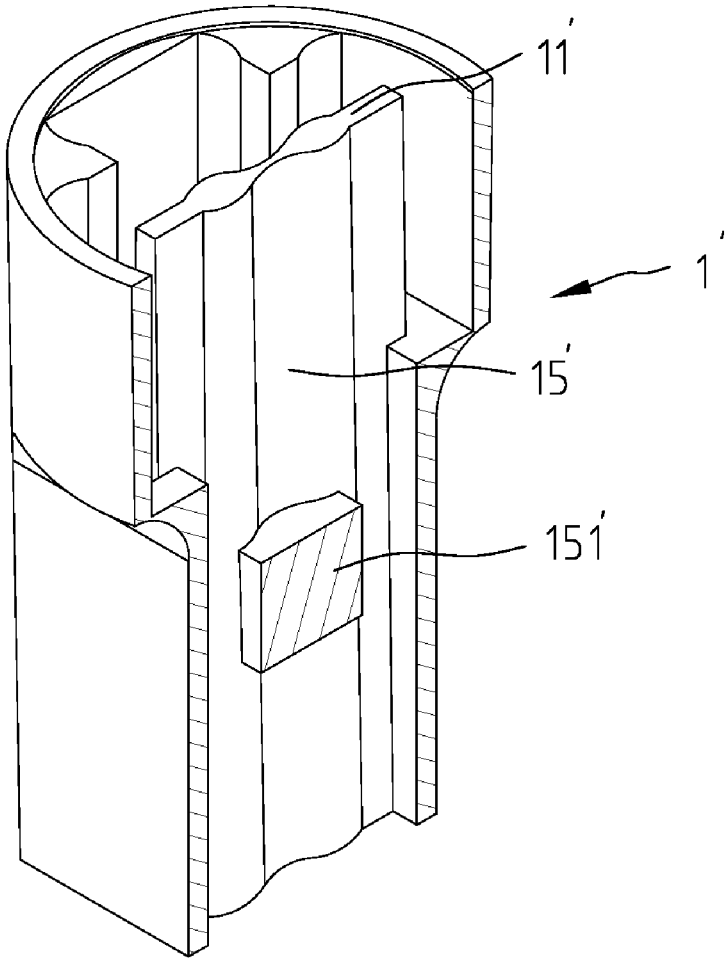
FIG. 5 shows a cross-sectional view of the light holder of the Christmas light according to the present invention.
Figure 5A:
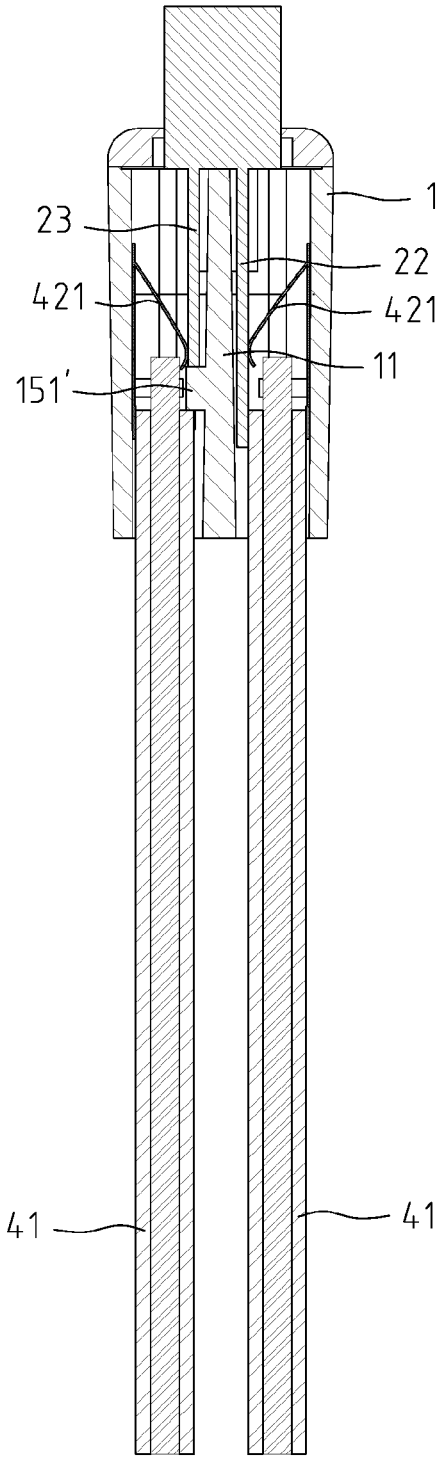
FIG. 5A shows a cross-sectional view of another embodiment of the Christmas light according to the present invention.

To further simplify the assembly of inserting pins 22, 23 of LED light bulb 2 respectively into two cavities 12 to contact respective flexible electrodes 42 correctly, another embodiment of the present invention includes a restrictive block 151' on a guiding channel 15' of a surface of separating part 11' of light holder 1', as shown in FIG. 5 and FIG. 5A. Restrictive block 151' is located lower than the position of contact part 421 of flexible electrode 42 after assembling wire 41 into light holder 1'. Assume that shorter pin of LED light bulb 2 is negative pin 23 and wire 41 inside cavity 12 with restrictive block 151'is also negative, when assembling LED light bulb 2, it is only necessary to insert short pin 23 into cavity 12 with restrictive block 151'.

Figure 6:
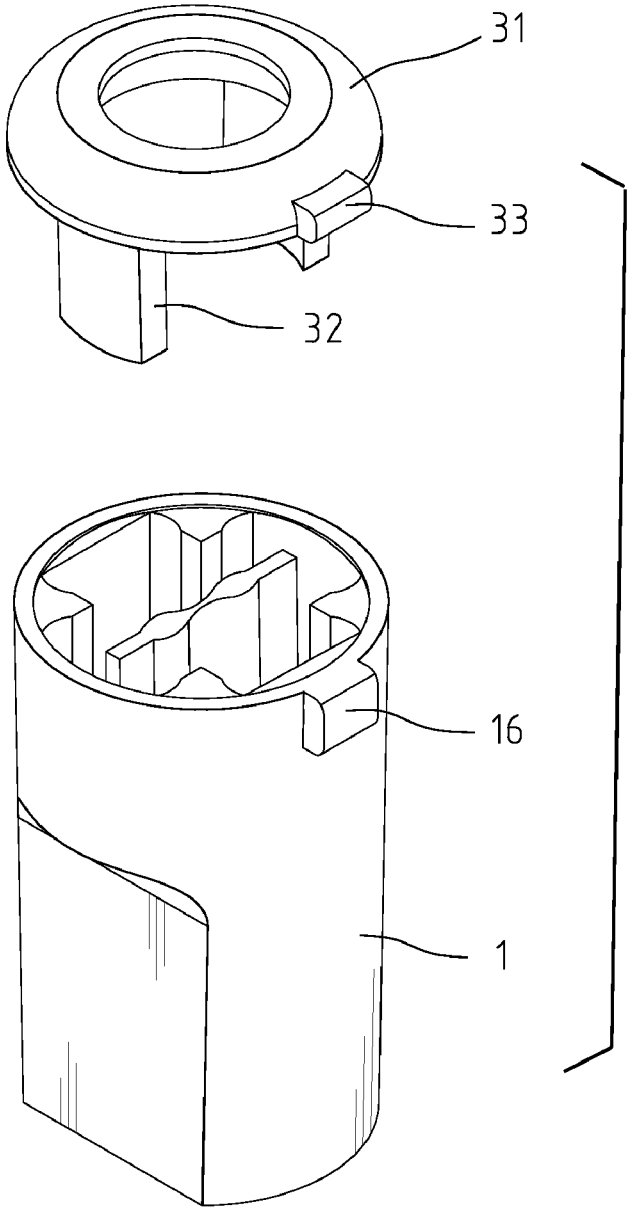
FIG. 6 shows a dissected view of light cap and light holder of the Christmas light according to the present invention.

In addition, when installing light cap 3, to avoid inserting plugging part 32 into lock trench 14, a convex edge 16, 33 (as shown in FIG. 6), or other convex edge of matching shape, can be included on the outer surface close to the top of light holder 1 and the outer surface of holding part 31 of light cap 3. By matching two convex edges 33, 16 of holding part 31 and light holder 1, plugging part 32 can be inserted into corresponding slot 13. The inclusion of restrictive block 151' and convex edges 33, 16 of FIG. 5 can further expedite the speedy and correct assembly.

Figure 7B:
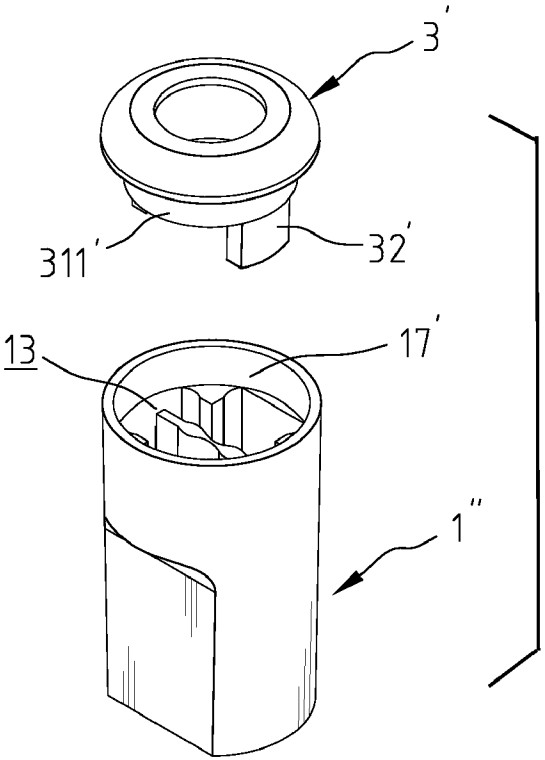
FIG. 7B shows a dissected view of light cap and light holder of the Christmas light according to the present invention.
Figure 7A:
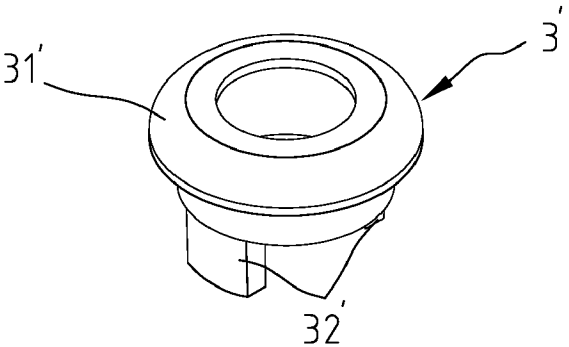
FIG. 7A shows a schematic view of another embodiment of the light cap of the Christmas light according to the present invention.

To further enhance the tight hold of light cap and light holder, the present invention shows a different light cap 3', as shown in FIG. 7A and FIG. 7B. The holding part of the light cap is designed as a leveled shape. When light cap 3' and light holder 1" match, the insertion of plugging part 32' into slot 13 of light holder 1" will make small diameter 311' of holding part 31' in contact with a ring inner wall 17' of the top of light holder 1", and large diameter 31' in contact with the top surface of light holder 1". The increase of contact surface also increases the tightness of light cap 3' and light holder 1".

Figure 8C:
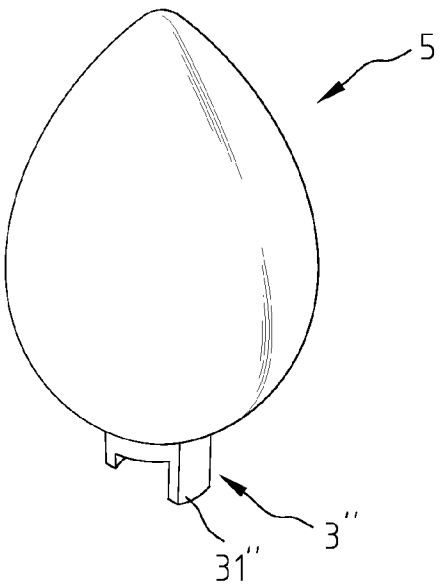
FIG. 8C shows a schematic view of forming shade on light cap of another embodiment of the present invention.
Figure 8B:
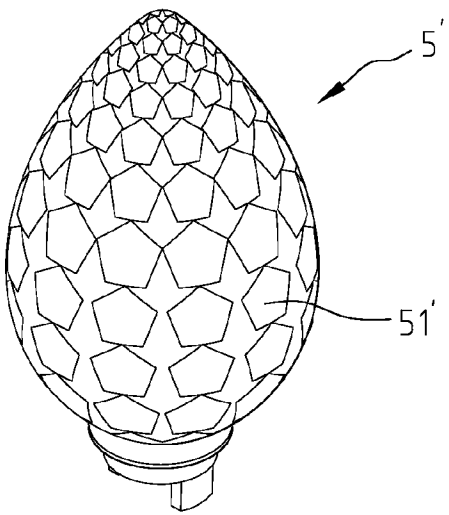
FIG. 8A and FIG. 8B show schematic views of forming shade on light cap of the two embodiments of the present invention respectively.
Figure 8A:
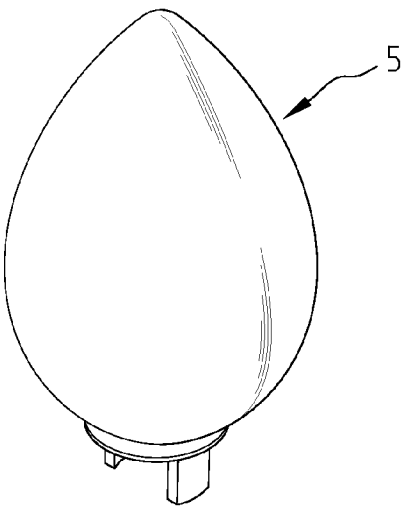

To protect LED light bulb 2 and increase decorative functionality of light range, the present invention can form a shade on the light cap. The shade can be formed on the top of light cap 3, 3' (FIG. 8A, FIG. 8B), or light cap 3" (FIG. 8C). Light cap 3" differs from the previous embodiments in that holding part 31" does not include convex edge. The shape, pattern and color of shade 5 is not limited to any specific design. For example, shade 5 can be designed as a water drop shape or forming a plurality of facets 51' on the surface of shade 5'. When the light is lighted, the illumination has a visual effect of glistering diamond.

Figure 9B:
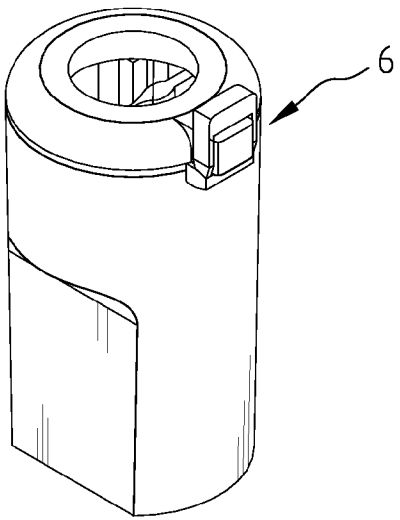
FIG. 9B shows a schematic view of the assembled buckle structure of the Christmas light according to the present invention.
Figure 9A:
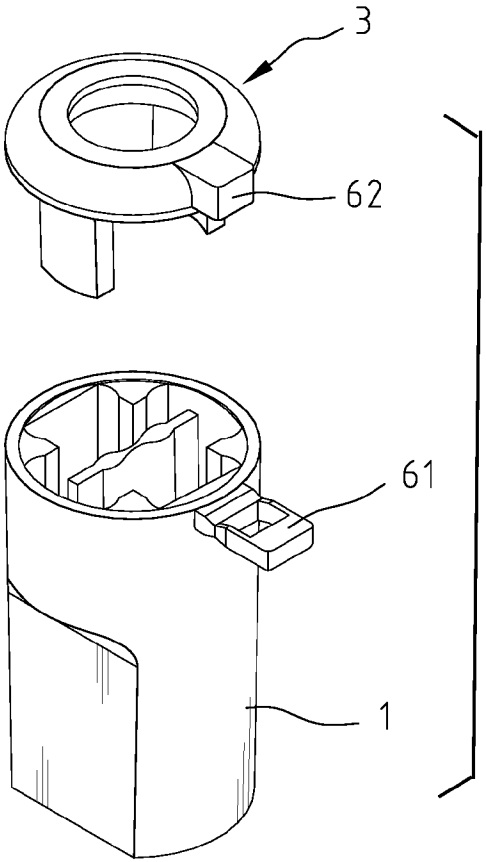
FIG. 9A shows a dissected view of the buckle structure of the Christmas light according to the present invention.

FIG. 9A and FIG. 9B show an example of using first embodiment of light cap 3. To prevent light cap 3 from falling off light holder 1, a buckle structure 6 can be included between light cap 3 and light holder 1. Buckle structure 6 is not limited to any specific design. In this embodiment, buckle structure 6 includes a square handle part 61 formed on the outside close of the top of light holder 1. Handle part 61 is resilient and flexible. Light cap 3 includes a long lock 62 at the corresponding location. After light cap 3 is assembled to light holder 1, handle part 61 is bended upwardly so that lock 62 is restricted inside the opening of handle part 61 so as to prevent light cap 3 from falling out of light holder 1.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A structure for a Christmas light, comprising:

a light holder having a hollow body and having a skeltonized top and a skeletonized bottom, said light holder also having an inner wall and a separating part formed crossing to the inner wall to divide a hollow interior of said light holder into two cavities, each of two opposite sides of said inner wall which are connected to said separating part forming a slot extending downwards from the top of the light holder, each opposing side of said separating part having a concaved surface forming a guiding channel, each of two opposite sides of said inner wall which face said separating part having a lock trench;

two wire sets fixed respectively inside said two lock trenches, each said wire set having a wire and a flexible electrode;

a light-emitting diode (LED) light bulb having a positive pin and a negative pin, each pin extending into a respective guiding channel and being electrically connected to a respective wire set;

a light cap, comprising a cylinder-shaped holding part for said LED light bulb to pass through, and two plugging parts for plugging into said two slots so as to fix said LED light bulb to said light holder; and a buckle structure having a first component connected to said holding part, and a second component connected to said light holder, said first component being engageable with said second component to prevent said light cap from falling out of said light holder.

2. The structure as claimed in claim 1, wherein an outer surface of said light holder close to the top of said light holder comprises a convex edge, and an outer surface of said holding part of said light cap also comprises a convex edge for easy identification during assembly.

3. The structure as claimed in claim 1, wherein said separating part comprises a restrictive block formed on one surface of said separating part, said restrictive block being located on a respective guiding channel close to the bottom of said light holder for easy identification of said positive and negative pins during assembly.

4. The structure as claimed in claim 1, wherein said holding part is a cylinder-shaped leveled body, and said plugging parts extend out from an end with a smaller outer diameter of said cylinder-shaped leveled body.

5. The structure as claimed in claim 4, wherein when said plugging parts enter said slots, the end with the smaller outer diameter of said cylinder-shaped leveled body is close to the inner wall at the said top of said light holder, and an end with a larger outer diameter of said cylinder-shaped leveled body is tightly abutted against said top.

6. The structure as claimed in claim 1, wherein a top of said holding part comprises a shade monolithically-formed with said holding part.

7. The structure as claimed in claim 4, wherein a top of said holding part comprises a shade monolithically-formed with said holding part.

8. The structure as claimed in claim 1, wherein each of the two lock trenches extends from said top to said bottom for guiding said wire set and for locking said wire set in said cavities.

9. The structure as claimed in claim 1, wherein said flexible electrode has a J-shaped flexible contact part and two protruded edges.

* * * * *